United States Patent [19]

Geafer et al.

[11] 4,175,529

[45] Nov. 27, 1979

[54] REGULATING DEVICE

[75] Inventors: Salahaddin Geafer, Markdorf; Gerhard Zbikowski, Salem, both of Fed. Rep. of Germany

[73] Assignee: Motoren- und Turbinen-Union Friedrichafen GmbH, Fed. Rep. of Germany

[21] Appl. No.: 813,300

[22] Filed: Jul. 6, 1977

[30] Foreign Application Priority Data

Jul. 13, 1976 [DE] Fed. Rep. of Germany ..... 2631381

[51] Int. Cl.[2] ..... F02D 1/04

[52] U.S. Cl. ..... 123/140 R

[58] Field of Search ..... 123/140 R, 140 FG

[56] References Cited

U.S. PATENT DOCUMENTS

| | | | |
|---|---|---|---|
| 2,758,584 | 8/1956 | Hogeman et al. | 123/140 R |
| 3,530,845 | 9/1970 | Staudt et al. | 123/140 R |
| 3,659,570 | 5/1972 | Yoshino | 123/140 R |
| 3,924,594 | 12/1975 | Aoki | 123/140 R |
| 3,926,164 | 12/1975 | Vuaille | 123/140 R |
| 3,938,488 | 2/1976 | Aoki | 123/140 R |

FOREIGN PATENT DOCUMENTS

| | | | |
|---|---|---|---|
| 213146 | 1/1961 | Austria | 123/140 R |
| 2426298 | 12/1974 | Fed. Rep. of Germany | 123/140 R |

*Primary Examiner*—Charles J. Myhre
*Assistant Examiner*—Andrew M. Dolinar
*Attorney, Agent, or Firm*—Craig and Antonelli

[57] ABSTRACT

A regulating device for an internal combustion engine, including a centrifugal governor, a linkage for determining initial tension of the governor spring and a restoring linkage, is constructed with a control track and movable element acting in cooperation to adjust the coefficient of fluctuation for the characteristic operating curves of the engine.

17 Claims, 2 Drawing Figures

Figure 1:
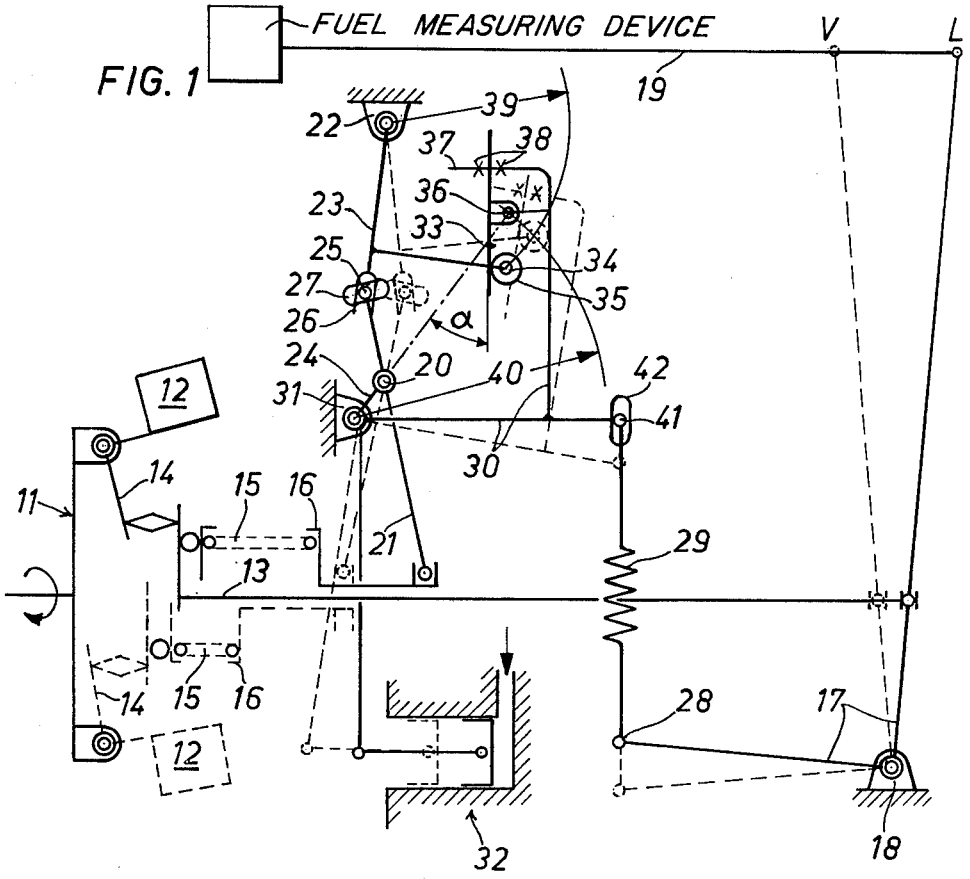

FUEL MEASURING DEVICE
V
L
19
22
39
37
38
36
23
33
25
34
27
35
26
α
24
20
40
42
31
41
12
30
11
14
15
16
21
29
13
14
15
16
28
17
12
32
18

49
50
58
57
ENGINE TORQUE
53
54
55
56
51
ENGINE SPEED
52
48

REGULATING DEVICE

This invention relates to a regulating device or arrangement for an internal combustion engine comprising a centrifugal governor, a predetermined value linkage with which the initial tension of the governor spring may be altered, and a restoring linkage connected with the muff coupling or sleeve coupling of the centrifugal governor, and particularly, to an arrangement wherein the position of the predetermined value linkage is influenced or dependent on the muff coupling travel of the governor.

The speed of rotation of an engine is determined by the value of the initial tension of the governor spring at the attainment of which the fuel charge to the internal combustion engine is reduced. By means of the restoring linkage, a change of the governor spring initial tension is accomplished with progressive decreasing of the fuel charge, or increasing thereof, so that a family of characteristic operating curves for the internal combustion engine shows a regulating curve having a definite inclination. It should be possible to make this inclination of the regulating curve, also known as the coefficient of fluctuation, variably large for different applications of the internal combustion engine, and, as a result, the governor can therefore, be made adjustable.

The present invention develops a connection between the predetermined value linkage and the restoring linkage of the governor in such a way that an accurate setting of the inclination of the regulating curve can be established. In this case, the variation or swinging of the regulating curve can take place about a given point; that is, at this point, coordination between the predetermined nominal value setting and sleeve or muff coupling position, through various possible settings of the coefficient of fluctuation, is not altered. Finally, for applications of the internal combustion engine, it should be possible to shift or move this point of variation along the regulating curve; that is, it can be adjustable between full load and no-load fuel charging.

This feature of the present invention is achieved by arranging a control track between the predetermined value linkage and the restoring linkage, which control track is swingable and adjustable about a swinging axis and connected to one linkage, and further, by a sliding element, or rolling element, arranged operatively cooperating with the control track, and connected to the other linkage through a joint member. It is further established that in every position of the sleeve coupling, the swinging axis of the control track and the joint member of the sliding or roll element can be selectively set coaxially one with respect to the other. Because of the variable adjusting possibilities of various swing angles at the control track, the coefficient of fluctuation may be adjusted in a simple manner since this changes the transmission rate between restoring linkage and predetermined value linkage, and therewith, the influence of the fuel charging change to the regulating spring.

In the coaxial position of the swinging axis of the control track and the joint member of the sliding or roll element, the control track may be swung so as to change the coefficient of fluctuation without thereby changing the position of the spring abutment or stop, and therewith, a change in the coordination between predetermined value setting and sleeve coupling position. This coaxial position of the swinging axis and joint member represents the swinging point or pivot of the regulating curve.

The adjustment of the coaxial position at every desired position of the sleeve coupling of the governor achieves that the pivot of the regulating curve may be coordinated to any fuel charge to the internal combustion engine, and be thereby, moved along the regulating curve.

In a further advantageous feature of the present invention, a simple coordination of the predetermined value setting to the position of the spring abutment may be established. In addition, a simple setting of various regulating or governor spring prestressing values results in rotative speed-predetermined value setting. A simple coordination of the coaxial position of the swinging axis of the control track and the joint member of the sliding or roll elements to any sleeve coupling position, is also possible. Finally, it is a feature of the present invention that the course of the regulating curve may be determined or fixed within wide limits, and, for example, aside from the usual straight lines, convex or concave curves may be established.

Figure 2:
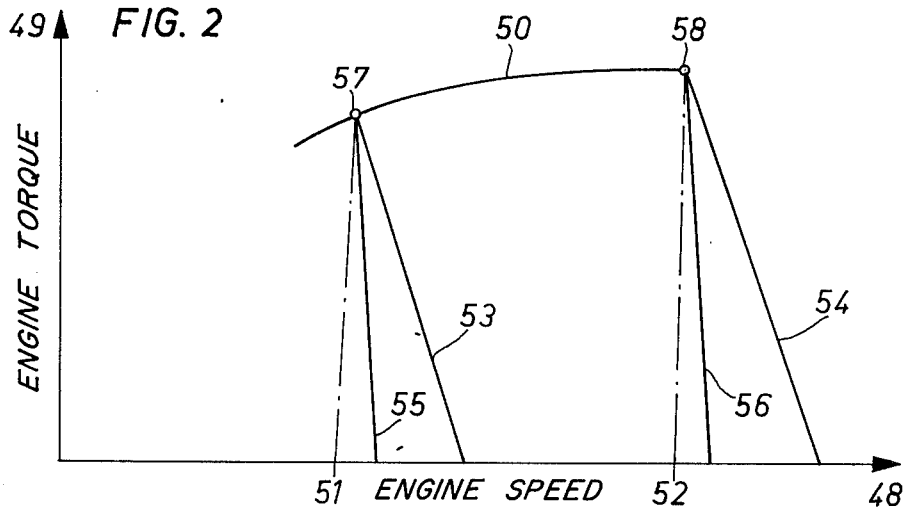

These and other objects, features, and advantages of the present invention will become more apparent from the following description when taken in connection with the accompanying drawing figures, which show for purposes of illustration only one embodiment in accordance with the present invention, and wherein:

FIG. 1 shows a schematic illustration of a regulating linkage constructed in accordance with the present invention; and FIG. 2 shows the torque curve of a diesel internal combustion engine with its regulating curve being adjustable in accordance with the present invention.

In FIG. 1, a centrifugal governor 11, driven proportionally to the speed of an internal combustion engine (not shown) consists of rotating flyballs or flyweights 12, a sleeve or muff coupling 13 onto which the centrifugal force of the flyballs acts through levers 14, a governor spring 15, and an adjustable spring abutment or stop 16. The travel of the sleeve coupling 13 is transmitted through an angle lever 17, which is rotatably supported in a fixed point 18, to a regulating link 19 which is connected with a fuel measuring device to adjust the quantity of fuel injected.

The upper half of the centrifugal governor 11 is shown with extended or swung-out flyballs 12. In this case, the rotative speed of the internal combustion engine is larger than a nominal predetermined value, and the sleeve coupling 13, lever 17 and regulating link 19 are in the position designated "L" for minimum injection of fuel, i.e. a noload fuel quantity. The lower half of the centrifugal governor 11 (shown in dashed lines) illustrates the case of lesser extended or swung-out flyballs 12 than that at the upper half. The rotative speed of the internal combustion engine is then below the predetermined nominal value; and the sleeve coupling 13, lever 17 and regulating link 19 are in position designated "V" for maximum injection of fuel or a full load fuel quantity.

The predetermined nominal value linkage consists of a first lever 21, rotatably supported at a movable pivot point 20, and a second lever 23 rotatably supported at a fixed pivot point 22. The first lever 21 of the predetermined nominal value linkage serves to pretension the governor spring 15. For this purpose, an eccentric 24 is rotated about a fixed pivot point 31 by means of a predetermined nominal value setting arrangement (not shown). At the other end of the eccentric 24, the first lever 21 is supported at movable pivot point 20.

The two levers 21 and 23 of the predetermined nominal value linkage are connected with each other through a movable joint point 25. This joint point is adjustable in a fork 26 of the second lever 23 and is adjustable and fixingly arranged in an elongated slot 27 of the first lever 21. Upon rotation of the eccentric 24, the joint point 25 acts as a fixed point about which the lever 21 swings so that the spring abutment 16 may be adjusted to change the pretension of the governor spring 15. The adjustability of the joint point 25 serves for a simple and quick coordination of the not-shown nominal value setting arrangement to the pretensioning of the governor spring 15. This setting is normally performed upon first starting of the internal combustion engine.

A restoring linkage is formed by a spring member 29, connected through a joint 28 with the angle lever 17, and further connected to the angle lever 30, which is rotatably supported at fixed point 31, and a damping device 32.

In accordance with the present invention, a control track 33 is connected to the restoring linkage; and a sliding or roll element 35 operatively cooperates with the control track, and is connected to the nominal value linkage through a joint 34. The control track 33 and sliding or roll element 35 are arranged between the nominal value linkage and restoring linkage. The control track is rotatable about a pivot axis 36, and is adjustable and lockable by means of a threaded link 37 and nut 38.

The transmission rate between the restoring linkage and nominal value linkage is thereby dependent on the value of the angle $\alpha$, which is formed by the connecting line between pivot 31 and pivot axis 36 and by the control track 33. At an angle $\alpha$ of 90°, and with an arc shaped control track, no influence of the governor spring pretension is provided by the restoring mechanism. The coefficient of fluctuation adjusts itself on the basis of the governor predetermined nominal values. At $\alpha<90°$, a decrease occurs of the coefficient of fluctuation, while at $\alpha>90°$ an increase of the coefficient of fluctuation occurs.

Because of the support arrangement of the second lever 23 of the predetermined nominal value linkage at the fixed point 22, the joint 34 of the sliding or roll element 35 describes an arc with a radius 39 upon a swinging of lever 23. From the support arrangement of the angle lever 30 of the restoring linkage at the fixed point 31, the pivot axis 36 of the control track 33 describes an arc with a radius 40 during swinging of the angle lever 30. At the intersection of the two arcs established by the radii 39 and 40, the coaxial position of the pivot axis 36 of the control track and of the joint 34 of the sliding or roll elements 35, is determined. For simple coordination of the coaxial position of the pivot axis 36 and joint 34 to a selected position of the sleeve coupling 13, an elongated slot 42 is provided at the end of the angle lever 30 in which a joint point 41 is adjustably and lockably arranged between the angle lever 30 and the spring member 29. This setting is accomplished during assembly of the governor.

In FIG. 2, the rotative speed of a diesel internal combustion engine is designated by axis 48 and the torque is designated by axis 49. A full load torque curve 50 of the diesel internal combustion engine is illustrated by two predetermined nominal rotational speeds 51 and 52 with various pretensions of the governor spring 15.

To alter the inclination of the regulating curve in accordance with the utilization purposes of the internal combustion engine, a change in the coefficient of fluctuation of the regulating curves is provided. Thus, from the nominal value of the regulating arrangement, determined from flyball mass, spring constant of the governor spring, and geometric measurements, a predetermined coefficient of fluctuation results corresponding to the regulating curves 53 and 54. Changing the coefficient of fluctuation causes the regulating curves to become steeper, for example, such as according to regulating curve 55, 56.

According to the construction of the regulating linkage of the present invention, the regulating curves intersect upon a change of the coefficient of fluctuation at points 57, 58, for example, on the full load curve so that a change of the previously determined nominal rotative speed does not occur.

While we have shown and described only one embodiment in accordance with the present invention, it is undestood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

We claim:

1. Regulating arrangement for an internal combustion engine, the arrangement comprising a centrifugal governor means having a governor spring, a first linkage means for altering a pretension of the governor spring, means for coupling the centrifugal governor with a fuel measuring device, said coupling means being mounted so as to be displaceable by said centrifugal governor means, restoring linkage means operatively connected with the coupling means for changing the position of said first linkage means in dependence upon the displacement of the coupling means, an adjustable control means for controlling a positioning of one of said linkage means, means for mounting said control means so as to be pivotable about a first pivot axis for adjustment thereof and for connecting said control means with said one of said linkage means, a moving element operatively cooperating with said control means, means defining a second pivot axis for connecting said moving element with the other of said linkage means such that the moving element is pivotable about a second pivot axis, said control means and said moving element being arranged between said first linkage means and said restoring linkage means, and means provided on at least one of the linkage means for enabling a selective adjustment of at least one of the pivot axis of said control means and the pivot axis of the moving element so that the first and second pivot axes may be selectively adjusted so as to be coaxial with respect to one another in every position of the coupling means.

2. Regulating arrangement according to claim 1, wherein said first linkage means includes a first and second lever, a movable pivot means for rotatably supporting said first lever, a fixed pivot means for rotatably supporting said second lever, a joint means for connecting said first and second levers with each other, a fork provided in one of said first and second levers, and wherein said means for enabling selective adjustment of the pivot axis includes an elongated slot provided in the other of said first and second levers, said joint means being adjustably and lockably arranged in the elongated slot and adjustably arranged in the fork.

3. Regulating arrangement according to claim 2, wherein an eccentric means is provided for adjusting the position of the movable pivot means, and a second fixed pivot means is provided for supporting said eccentric means.

4. Regulating arrangement according to claim 1, wherein said restoring linkage means includes a first and second member, joint means disposed between the first and second members and wherein said means for enabling selective adjustment of the pivot axes includes an elongated slot in one of said first and second members, said joint means being adjustably and lockably received in said elongated slot.

5. Regulating arrangement according to claim 1, wherein said control means is constructed corresponding to a predetermined course of a regulating curve of the internal combustion engine.

6. Regulating arrangement according to claim 1, wherein said coupling means includes a coupling sleeve, a regulating link, a lever means for connecting said coupling sleeve to said regulating link, and a first fixed pivot means for rotatably supporting said lever means.

7. Regulating arrangement according to claim 6, wherein said restoring linkage means include a restoring spring means and a second lever means, a second fixed pivot means for rotatably supporting the second lever means, said restoring spring means being interposed between said first and second lever means.

8. Regulating arrangement according to claim 7, wherein said first linkage means includes a first and second lever, a movable pivot means for rotatably supporting said first lever, a third fixed pivot means for rotatably supporting said second lever and a joint means for connecting said first and second levers, said joint means being arranged between said movable pivot means and said third fixed pivot means.

9. Regulating arrangement according to claim 8, wherein an eccentric means is provided for adjusting the position of the movable pivot means, said eccentric means being rotatably supported at said second fixed pivot means.

10. Regulating arrangement according to claim 9, wherein said moving element is one of a sliding member and rolling member.

11. Regulating arrangement according to claim 10, wherein said control means includes a control track operatively connected with said second lever means.

12. Regulating arrangement according to claim 11, wherein said means for connecting said moving element includes a further joint means for operatively connecting the moving element to said second lever.

13. Regulating arrangement according to claim 12, wherein an adjustable stop means is provided for the governor spring and wherein means are provided for operatively connecting said adjustable stop means to said first lever.

14. Regulating arrangement according to claim 13, wherein said restoring means further includes a damper means.

15. Regulating arrangement according to claim 1, wherein said moving element is one of a sliding member and a rolling member.

16. Regulating arrangement according to claim 1, wherein said control means includes a control track operatively connected with the restoring linkage means.

17. Regulating arrangement according to claim 1, wherein an adjustable stop means is provided for the governor spring, and wherein means are provided for operatively connecting said adjustable stop means to said first linkage means.

* * * * *